United States Patent [19]

Sharber

[11] Patent Number: 4,531,698

[45] Date of Patent: Jul. 30, 1985

[54] BRACKET FOR SECURING ADJUSTABLE SHELVING

[75] Inventor: Jerry L. Sharber, Toledo, Ohio

[73] Assignee: Sheller-Globe Corporation, Toledo, Ohio

[21] Appl. No.: 402,305

[22] Filed: Jul. 27, 1982

[51] Int. Cl.[3] ..... A47G 29/02

[52] U.S. Cl. ..... 248/243; 52/36; 108/108; 211/189

[58] Field of Search ..... 248/243, 235, 241, 244, 248/250, 297.3, 260, 272; 211/189, 192, 186; 108/108, 109, 60; 52/36, 238.1

[56] References Cited

U.S. PATENT DOCUMENTS

| | | | |
|---|---|---|---|
| 3,158,265 | 11/1964 | Thimons | 248/243 |
| 3,273,720 | 9/1966 | Seiz | 248/243 |
| 3,759,297 | 9/1973 | Anderson et al. | 248/243 |
| 4,134,564 | 1/1979 | Hanna | 248/243 |
| 4,205,815 | 6/1980 | Sauer et al. | 52/36 |
| 4,378,925 | 4/1983 | Griffin | 108/108 |
| 4,387,872 | 6/1983 | Hogue | 248/243 |

*Primary Examiner*—William H. Schultz
*Assistant Examiner*—Ramon O. Ramirez
*Attorney, Agent, or Firm*—Fraser & Clemens

[57] ABSTRACT

The present invention relates to a bracket for securely fastening a shelf support to an upstanding support member in an adjustable shelving system. The bracket includes an elongate main body having a pair of spaced apart, outwardly extending arms. The arms are adapted to be inserted through slots formed in the shelf support and are then secured to the upstanding support member. A pair of spaced apart set screws are mounted on the main body and are adapted to urge the shelf support into secure engagement with the upstanding support member.

3 Claims, 4 Drawing Figures

BRACKET FOR SECURING ADJUSTABLE SHELVING

BACKGROUND OF THE INVENTION

The present invention relates generally to a bracket for securing two members in fixed relation relative to one another and, in particular, to a bracket utilized to secure a shelf support in an adjustable shelving system.

Adjustable shelving systems are commonly used in retail stores, factories, warehouses, libraries, offices, and homes. A wide variety of systems is available. Some of these systems include spaced apart side walls each having a plurality of grooves formed on the inner side thereof for receiving and supporting a shelf at a desired height. Other systems include a plurality of spaced apart vertical support members which are secured to a wall, for example. In these systems, a plurality of shelf supports are secured to the vertical support members at selected locations in order to support a shelf at a desired height.

SUMMARY OF THE INVENTION

The present invention is concerned with a bracket for use in adjustable shelving systems of the type described above which include spaced apart vertical support members and individual shelf supports. The bracket of the invention is used for securely attaching a shelf support to an associated vertical support member.

The bracket includes an elongate main body having a pair of spaced apart, transversely extending arms adapted to be inserted through corresponding slots formed in the shelf support. The outer ends of each arm is provided with means for securing each arm to the associated vertical support member.

The bracket includes adjusting means mounted on the main body for urging the shelf support and the vertical support member toward one another for securely fixing the shelf support relative to the vertical support member. In the preferred embodiment of the invention, such adjusting means includes a pair of spaced apart set screws mounted in the main body.

BRIEF DESCRIPTION OF THE DRAWINGS

The above, as well as other objects and advantages of the invention, will become manifest to one skilled in the art from reading the following detailed description of an embodiment of the invention when considered in light of the accompanying drawings in which.

DESCRIPTION OF THE PREFERRED EMBODIMENT

Figure 1:
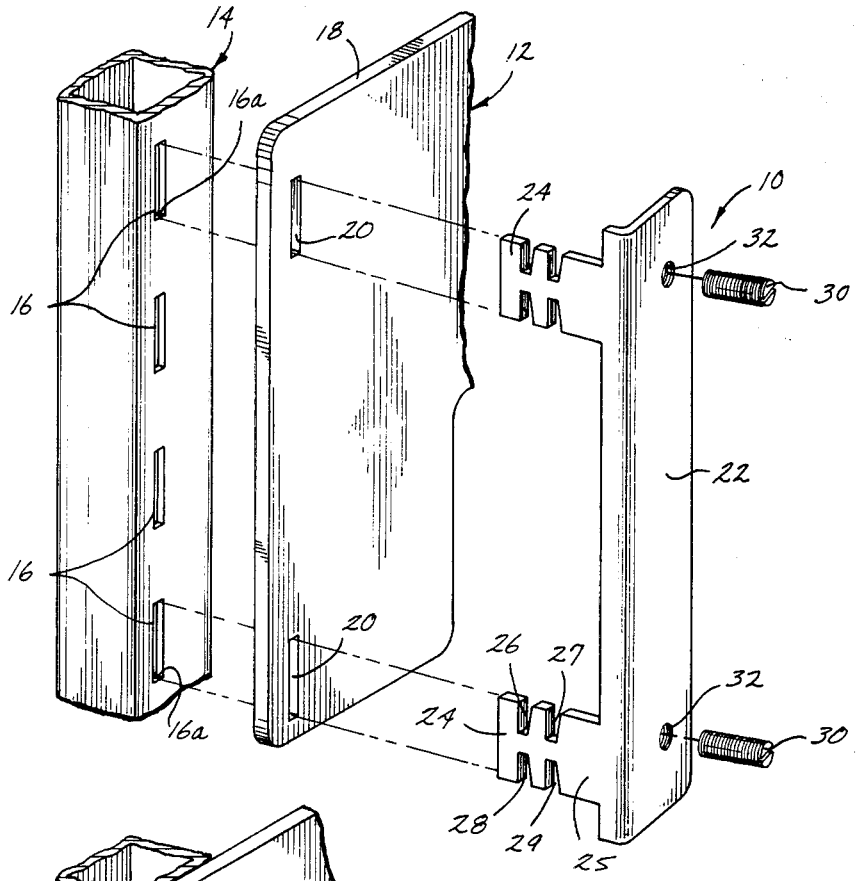
FIG. 1 is an exploded perspective view illustrating the securing bracket of the present invention along with an associated shelf support and a vertical support member.
Figure 2:
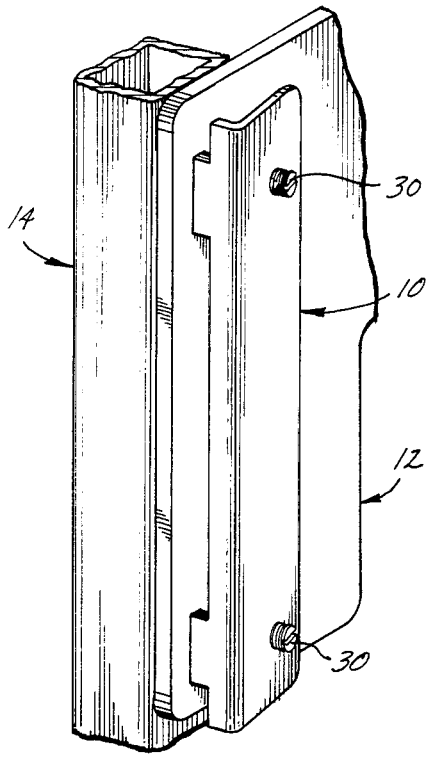
FIG. 2 is a perspective view illustrating the components of FIG. 1 in an assembled relationship.

Referring to FIGS. 1 and 2, there is shown a securing bracket 10 which can be utilized for securely attaching a shelf support 12 to an associated longitudinally extending support member 14. The support member 14 in FIGS. 1 and 2 is illustrated as a portion of a longitudinally extending hollow member having a generally rectangular cross-section. The support member 14 is typically provided with means (not shown in the drawings) for securely positioning the member 14 in a generally vertical, upright position. For example, the support member 14 can be secured to a wall with suitable fasteners.

The support member 14 includes a plurality of spaced apart elongate slots 16 which extend along one side of the member. The shelf support 12 has an upper marginal edge 18 which is adapted to engage and support a portion of a shelf (not shown). The shelf support 12 includes a pair of elongate slots 20 which are spaced apart a distance corresponding with two of the slots 16 in the member 14.

Figure 3:
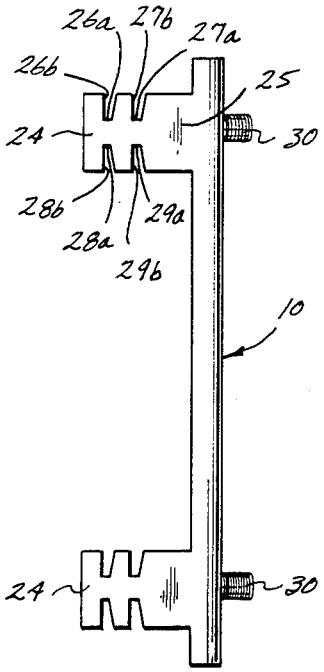
FIG. 3 is a side elevational view of the securing bracket of FIGS. 1 and 2.
Figure 4:
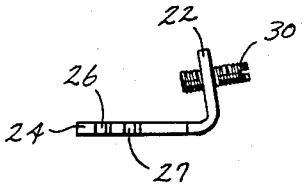
FIG. 4 is a top elevational view of the securing bracket of FIG. 3.

The bracket 10 includes an elongate main body 22 having a pair of spaced apart, transversely extending arms 24 adapted to be inserted through the slots 20 in the shelf support 12 and into two slots 16 in the support member 14. Each of the arms 24 includes an inner portion 25, two upwardly facing notches 26 and 27, and two downwardly facing notches 28 and 29. As will be discussed, a single notch in each arm is utilized to securely couple the respective arm to the support member 14. The particular notch which is used depends on the thickness of the shelf 12 and on which side of the member 14 the bracket 10 is positioned. As shown in FIG. 3, the upwardly facing notches 26 and 27 include generally horizontal support surfaces **26*a* and 27*a* and generally vertical camming surfaces 26*b* and 27*b* respectively. Similarly, the downwardly facing notches 28 and 29 include generally horizontal support surfaces 28*a* and 29*a* and generally vertical camming surface 28*b* and 29*b*** respectively.

When the fastening device 10 is oriented relative to the support member 14 and the shelf support 12 in a manner as shown in FIG. 1, one of the downwardly facing notches 28 or 29 on each arm is utilized to securely coupled the arms to the support member 14. As previously mentioned, the arms 24 are inserted through the shelf support slots 20 and into the slot 16. The bracket 10 is then moved downwardly such that the lower surface **16*a* of the respective slot 16 engages the support surface 28*a* or 29*a* on one of the notches 28 or 29. The particular one of the notches 28 or 29 which is used depends on the thickness of the shelf support 12. For relatively thin-walled shelf supports, as shown in FIG. 1, the inner notch 29 is used while, for relatively thick-walled shelf supports, the outer notch 28 is used. Once the arms have been inserted through the shelf support 12 and secured to the support member 14 the shelf support will be supported by the inner portion 25 of the arms 24**.

In instances where the bracket 10 must be inverted before assembly, the notches 26 and 27 will face downwardly and one of these notches can then be used to couple the respective arm to the support member.

The present invention provides means for maintaining the shelf support 12 in fixed relation relative to the support member 14. Such means are shown in the drawings as a pair of spaced apart set screws 30 threaded into apertures 32 formed in the elongate main body 22 of the bracket 10. Once the bracket 10 and shelf support 12 have been positioned on the support member 14 as described above, the set screws 30 can be tightened to contact the side wall of the shelf support and urge the shelf support into secure engagement with the support member, as clearly shown in FIG. 2. As the screws 30 are tightened, the camming surfaces 29*b* of the notches 29 are moved into secure engagement with the inner wall of the hollow member 14 to securely lock the bracket 10 and the shelf support to the member.

In accordance with the provisions of the patent statutes, the principle and mode of operation of the invention have been explained and illustrated in its preferred embodiment. However, it must be understood that the invention can be practiced otherwise than as specifically illustrated and described without departing from its spirit or scope.

What is claimed is:

1. In a shelf support assembly including a vertically extending support member having at least a pair of spaced apart slots formed therein, a shelf support having a pair of spaced apart slots formed therein in alignment with the pair of slots formed in the support member, and a bracket for securing the shelf support to the support member, wherein the bracket comprises:

a main body;

a pair of spaced apart arms extending from said main body for insertion through the slots formed in the shelf support, each of said arms provided with notch means on the outer ends thereof for coupling said arms and said main body of the bracket to the support member;

threaded adjusting means threadably mounted on said main body for longitudinal movement toward and away from said main body and engageable with the shelf support for urging the shelf support and the support member toward one another to securely fix the shelf support to the support member.

2. The invention defined in claim 1 wherein said main body of the bracket includes a longitudinally extending generally planar wall, said spaced apart arms extending away from the wall of said main body at a right angle thereto, the coupling means of said arms including at least one notch formed in each of said arms and adopted to receive a portion of the wall of the support member whereby relative vertical movement between the bracket and the support member causes a portion of the support member adjacent the slots formed therein to be received by the notch means of said arms respectively.

3. The invention defined in claim 1 or 2 wherein said threaded adjusting means includes at least one set screw.

* * * * *